United States Patent [19]

Butlin

[11] Patent Number: 4,971,522

[45] Date of Patent: Nov. 20, 1990

[54] CONTROL SYSTEM AND METHOD FOR AC MOTOR DRIVEN CYCLIC LOAD

[76] Inventor: Duncan M. Butlin, 5707 E. 72nd Pl., Tulsa, Okla. 74136

[21] Appl. No.: 350,545

[22] Filed: May 11, 1989

[51] Int. Cl.[5] ..... F04B 49/00

[52] U.S. Cl. ..... 417/18; 417/24; 417/45; 417/53; 318/808

[58] Field of Search ..... 417/22, 44, 24, 45, 417/53; 318/811, 807, 808

[56] References Cited

U.S. PATENT DOCUMENTS

| | | | |
|---|---|---|---|
| 2,931,928 | 4/1960 | Fehn | 310/95 |
| 3,363,572 | 1/1968 | Jaeger . | |
| 3,393,642 | 7/1968 | Kordik et al. . | |
| 3,551,072 | 12/1970 | Zimmerly | 417/45 |
| 3,568,771 | 3/1971 | Vincent et al. | 166/250 |
| 3,667,012 | 5/1972 | Kilgore | 318/161 |
| 3,751,192 | 8/1973 | Boyd | 417/411 |
| 4,052,648 | 10/1977 | Nola | 318/200 |
| 4,076,457 | 2/1978 | Skinner et al. | 417/45 |
| 4,145,161 | 3/1979 | Skinner | 417/22 |
| 4,220,440 | 9/1980 | Taylor et al. | 417/12 |
| 4,315,203 | 2/1982 | Ibamoto et al. | 318/807 |
| 4,392,100 | 7/1983 | Stanton et al. | 318/808 |
| 4,413,218 | 11/1983 | Taylor et al. | 318/771 |
| 4,459,534 | 7/1984 | Nagase et al. | 318/811 |
| 4,493,613 | 1/1985 | Sommer | 417/15 |
| 4,499,414 | 2/1985 | Fujioka et al. | 318/807 |
| 4,544,873 | 10/1985 | Salihi et al. | 318/811 |
| 4,661,751 | 4/1987 | Werner | 417/53 |
| 4,723,452 | 2/1988 | Watson | 74/41 |
| 4,743,172 | 5/1988 | Watson | 417/362 |
| 4,752,725 | 6/1988 | Ominato | 318/807 |

*Primary Examiner*—Leonard E. Smith
*Assistant Examiner*—David W. Scheuermann
*Attorney, Agent, or Firm*—Laney, Dougherty, Hessin & Beavers

[57] ABSTRACT

A control system for an AC motor driven cyclic load, such as a beam pumping unit, includes a flywheel, transducer, tachometer, outside set point source, controller, and variable frequency power supply. The flywheel is rotatably connected between the motor and the cyclic load for receiving and storing rotational kinetic energy from the motor and the load during portions of a cycle of the cyclic load when there is excess energy and returning the stored rotational kinetic energy to drive the cyclic load during portions of a cycle when there is an energy demand by the cyclic load. The transducer generates a transducer signal which is a function of the cycle speed. The tachometer means generates a tachometer signal which is a function of the speed of rotation of the motor's rotor. The outside set point source generates an outside set point signal representative of a desired set point cycle speed of the cyclic load. The controller receives the transducer signal, the tachometer signal and the outside set point signal and generates a control signal representative of the adjustment to the power supply frequency of the motor needed to achieve the set point cycle speed. The variable frequency power supply receives the control signal and adjusts the frequency of the power supplied to the motor accordingly.

21 Claims, 6 Drawing Sheets

CONTROL SYSTEM AND METHOD FOR AC MOTOR DRIVEN CYCLIC LOAD

BACKGROUND OF THE INVENTION

This invention relates to control systems for electric motor driven cyclic loads and more particularly relates to a control system for an oil well beam pumping unit.

Crude oil occurs in oil bearing strata which may be many thousands of feet below the earth's surface. To produce this oil, wells are drilled and the fluid that collects in them is lifted to the surface, often by some means of artificial lift. The most common lifting device is a beam pumping unit, where a string of steel rods is hung from the beam pumping unit at the surface through the well down to a reciprocating pump at the oil strata level. The beam pumping unit at the surface imparts an up and down motion to the rods which in turn reciprocate the downhole pump to lift the fluid.

A typical beam pumping unit consists of the following components in power train order: an electric motor, belts and sheaves, gear box, crank and counterweights, pitman, walking beam, rod string, and downhole pump. The walking beam is moved up and down by a pivoted linkage (the pitman) to the rotating crank. The crank is rotated by the motor via the belts and sheaves and gear box. One complete crank rotation reciprocates the pump through one complete cycle of one upstroke and one downstroke.

The reciprocating action of the downhole pump imposes an intermittent load on the rod string. The fluid must be lifted on the upstroke, but not on the downstroke. The counterweights are placed at one end of the crank and are sized and phased to halve the load of the fluid and to double the loading frequency, i.e., the counterweights halve the effective load on the up stroke and provide artificial load on the downstroke. Nevertheless, the loading required to operate the beam pumping unit still varies dramatically throughout any one cycle of the pumping unit and is effectively reduced to zero as the downhole pump passes over the top of an upstroke and the bottom of a downstroke. This pumping load is seen as a widely varying speed and torque requirement by the electric motor.

An electric induction motor is normally a cost effective way of converting electrical energy to mechanical power, yet it is not suited to a varying load. To accommodate the varying load of the beam pumping unit, it is typical to choose a high slip version (Nema D) of electric induction motor in order to allow a small crank speed variation, even though there is an inherent loss of efficiency in doing so.

When an electric induction motor is used to power a beam pumping unit, energy losses in the surface equipment are even higher than expected. Although this problem has long been recognized, it is only in recent years that it has become important to the operator of beam pumping units. This is because with the increasing price of electricity and the decreasing percentage of oil produced per unit of electricity, electricity costs have become a large part of total oil production costs.

The basic cause of the problem is the mismatch between the power source and the load. An electric motor is designed to output a fairly constant level of mechanical energy, but the beam pumping unit is an intermittent or cyclic load which requires widely fluctuating power at the crank shaft to turn the crank through one cycle.

In addition to the lack of concern over energy losses in beam pumping units until recent years and therefore its nonrecognition as a serious problem, the nature of the energy loss problem in beam pumping units has been obscured by at least three factors:

(1) The detailed performance of electric induction motors under widely varying load conditions is not generally well understood, particularly when the motor behaves as a generator.

(2) The analysis of the behavior of the rod string, to which the surface equipment is attached, is particularly complex and requires the iterative use of mathematical algorithms. These algorithms are best performed by computers which inhibit further engineering insight.

(3) The analysis of the surface equipment performance of a beam pumping unit has traditionally been neglected because it does not significantly affect the choice of system components. In the past, the important parameters governing choice of equipment have been gear box torque and polished rod load.

Therefore, only parts of the problem have been correctly perceived and only partial solutions have been attempted. In fact, the issue of surface efficiency of a beam pumping unit has not often been addressed directly.

For example, past efforts to improve efficiency have focused on the perceived problem as being the large difference between the peak and average torque required by the beam pumping unit. The solution was to attempt to average or smooth out the mechanic load by changing the geometrical arrangement of the articulating and rotating subcomponents of the beam pumping unit and by improving the strength to weight ratio of the rod material. Both of these approaches reduce energy losses, although not normally by a very large amount.

Other efforts have perceived the problem as being that the motor is overloaded and underloaded through one cycle of the beam pumping unit with big differences between the peak torque and average torque required. The solution was to use an ultra-high slip motor to allow large speed variation in the motor. The ultra-high slip motor has a smaller than normal variation of torque output as its speed is varied, and thus the motor allows the speed to fluctuate as the load torque varies. The torque created by the acceleration and deceleration of the rotating components therefore reduces the peak and minimum torque seen by the gear box and the motor. In this way, gear box stresses and motor overload and underload are reduced. The ultra-high slip motor achieves this at the expense of low motor efficiency. Further, this approach cannot be taken to the logical extreme because very large motors are then needed and the motor becomes even more inefficient.

Other efforts have perceived the problem as being that speed variation in the cyclic load causes overload and underload of a standard electric motor and thus exacerbates energy losses. The solution was to attempt to hold the motor speed fairly constant, using a flywheel alone. This was attempted with a Nema D motor, therefore the size of the flywheel required was very large and the efficiency improvement was not very great.

Other efforts perceive the problem as being motor inefficiency due to varying loads and have attempted to solve the problem using variable frequency power supplies alone to avoid peak loads. This approach has been attempted several times unsuccessfully.

As previously mentioned, these prior attempts have only correctly perceived parts of the problem and have therefore only applied partial solutions.

The present invention identifies the cause of the extra and unexpected energy losses as the process of regeneration within the beam pumping unit. The problem is not the regenerated energy itself, which is not lost, but losses inherent in the act creating and transferring the energy to provide regeneration.

During a single crank cycle or pump stroke (one complete upstroke and downstroke), of the beam pumping unit, the crank turns one complete revolution. Normally, there are considerable periods during this revolution or cycle when the beam pumping unit actually forces the motor rotor to speed up (negative torque load). Under these circumstances, the motor rotor speed is often forced above the synchronous speed (defined by the speed of rotation of the magnetic field in the stator) and the motor becomes a line excited generator which feeds power back to the electrical supply while at the same time acting as a brake on the mechanical parts of the beam pumping unit, i.e., resisting attempts of the rotating crank and counterweights to speed up the rotor. This phenomenon is known as regeneration and is responsible for the severe increase in energy losses, both in the motor and in the beam pumping unit components.

It is important to distinguish between the recoverable energy, which is the regenerated energy returned to the power source, and the unrecoverable energy losses which are incurred in the various system components by the act of regeneration. It is not the regenerated energy itself that causes the inefficency problem, but instead it is the losses incurred in the process of producing the regenerated energy. This process consists of drawing the extra energy (which is to be regenerated) from the power source, storing it in the beam pumping unit, and in returning it to the line as regenerated energy. Obviously, this process cannot be accomplished loss free and therefore creates the unrecoverable energy losses and inefficiencies remedied by the present invention.

SUMMARY OF THE INVENTION

Accordingly, it is an advantage of the present invention to provide a control system for cyclic load driven by an electric motor, such as a beam pumping unit, which avoids all regenerative losses in the AC motor and eliminates all motor braking action.

It is an advantage of the present invention to constantly operate an electric motor driving a cyclic load at a high level of efficiency while eliminating high and low torque demands on the motor.

It is an advantage of the present invention to avoid regenerative losses in the gear box and mechanical components of a beam pumping unit by allowing speed variations to store energy on a flywheel, as well as on the crank, counterweights, and other rotating equipment.

Accordingly, the present invention provides a control system for an AC motor driven cyclic load, such as a beam pumping unit, which includes a flywheel, transducer means for generating a transducer signal which is a function of the cycle speed of the cyclic load; tachometer means for generating a tachometer signal which is a function of the speed of rotation of the motor's rotor, outside set point means for generating an outside set point signal representative of a desired set point cycle speed of the cyclic load, controller means, and a variable frequency power supply means.

The flywheel is rotatably connectable between the motor and the cyclic load for receiving and storing rotational kinetic energy from the motor and the load and for delivering rotational kinetic energy to the load. The flywheel stores rotational kinetic energy during portions of a cycle of the cyclic load when there is excess energy and returns the stored rotational kinetic energy to drive the cyclic load during portions of a cycle when there is an energy demand by the cyclic load. Normally, the cyclic load has subcycle speed and loading oscillations and the flywheel has a sufficiently large moment of inertia to control the subcycle oscillations.

The controller means receives and processes the transducer signal, the tachometer signal, and the outside set point signal to generate a control signal representative of the adjustment to the frequency of the power supplied to the motor which will achieve the set point cycle speed.

The variable frequency power supply means has a power input connectable to an AC power source and a power output connectable to the AC motor. The variable frequency power supply means receives and processes the control signal from the controller means in order to adjust the frequency of the power supplied to the AC motor and thereby achieve the set point cycle speed of the cyclic load.

In one embodiment, the controller means includes a speed controller means and a frequency controller means. The speed controller means receives and compares the transducer signal and the outside set point signal and generates a speed set point signal representative of the adjustment in the cycle speed needed to achieve the set point cycle speed of the cyclic load. The frequency controller means receives and compares the tachometer signal and the speed set point signal and generates the control signal. The control signal is supplied to the variable frequency power supply means to adjust the frequency of the power supplied to the motor and thereby adjust the difference between the speed of rotation of the motor's magnetic field and the speed of rotation of the motor's rotor (which adjusts the motor output torque), as needed to achieve the set point cycle speed of the cyclic load.

In another embodiment, the controller means includes speed controller means, slip set point means, and frequency controller means. The speed controller means receives and compares the transducer signal and the outside set point signal and generates a speed control signal representative of the adjustment in the output torque of the AC motor needed to achieve the set point cycle speed of the cyclic load. The slip set point means generates a slip set point signal representative of a desired set point difference between the speed of rotation of the motor's magnetic field and the speed of rotation of the motor's rotor. The frequency controller means receives and compares the tachometer signal and the slip set point signal and generates the control signal. The control signal is supplied to the variable frequency power supply means to adjust the frequency of the power supplied to the motor and thereby achieve the desired set point difference between the speed of rotation of the magnetic field and the speed of rotation of the rotor. The variable frequency power supply means also receives and uses the speed control signal to adjust the voltage output per unit of frequency to the AC motor in order to adjust the output torque of the AC motor and thereby the cycle speed of the cyclic load.

Preferably, in both of the embodiments discussed above, the speed controller means includes integrating means for delaying the response of the speed controller means to changes in the cycle speed of the cyclic load so that the cycle speed of the cyclic load or crank is adjusted slowly with respect to adjustments in the difference between the speed of rotation of the magnetic field and the speed of rotation of the rotor.

Unlike prior beam pumping units in which the motor is expected to provide a widely fluctuating torque to maintain the crank and beam pumping unit at a constant speed, in the present invention, the instantaneous subcycle speed of the beam pumping unit is allowed to vary as the load torque varies. This allows energy to be stored as rotational kinetic energy on the rotating elements which smoothes out or averages the torque extremes required of the motor. The inertia of the flywheel ensures that the speed variations are not extreme and the controller means and variable frequency power supply means ensure that the motor torque output is constant during any given cycle of the beam pumping unit.

Because the torque exerted on the crank shaft by the cyclic load is anything but constant, the motor output torque, when transferred to an available torque at the crank shaft rarely matches the load. In general, there is always a resultant net torque that will either accelerate or decelerate the rotating elements. Without the flywheel, the load torque varies so much and over such a long period that the motor must output a widely varying torque or the pumping unit will slow to a halt during high positive torque loads. The flywheel resists speed variations by virtue of its rotational inertia, i.e., it demands net positive torque to speed up and net negative torque to slow it down. This reduces the rates of acceleration and deceleration of the beam pumping unit.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
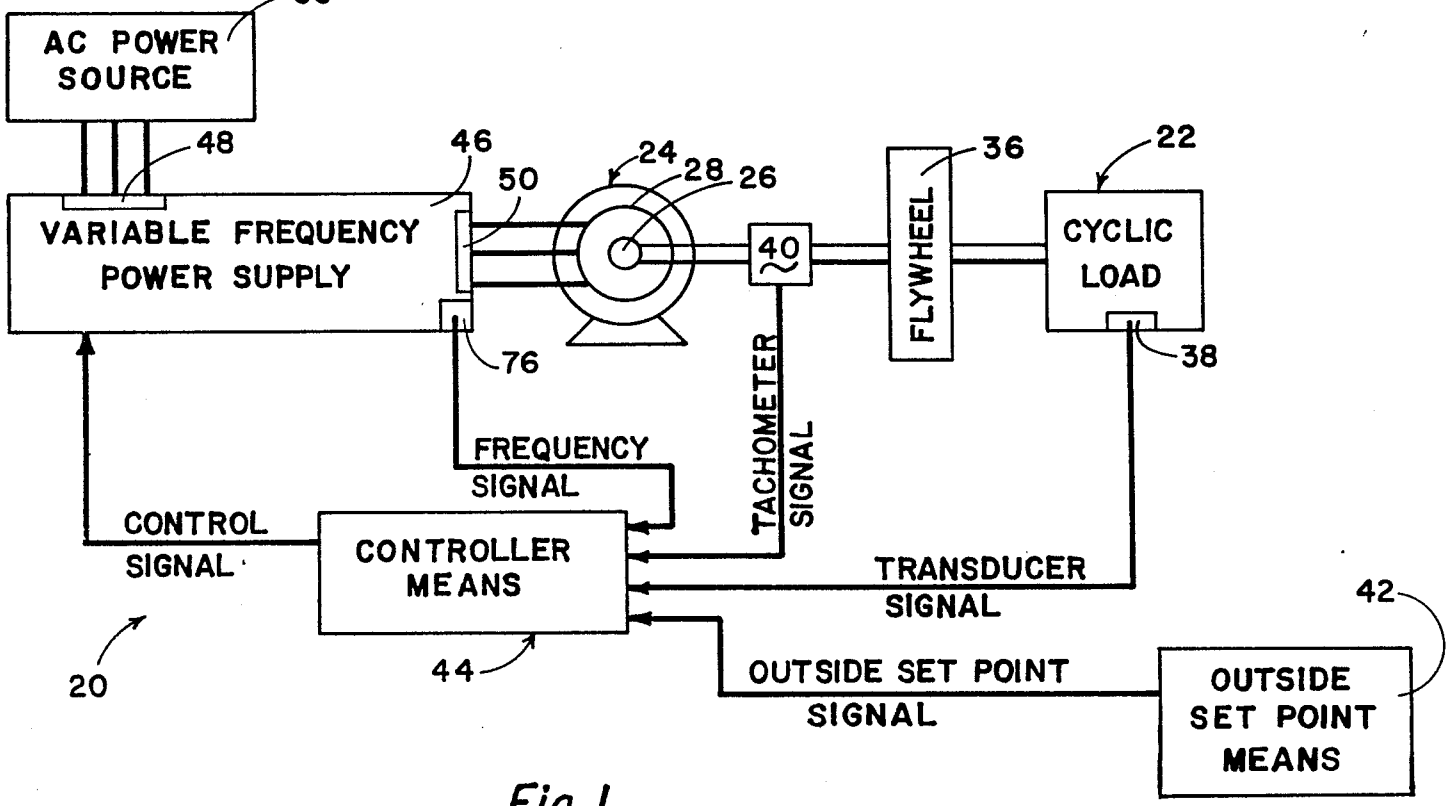
FIG. 1 is a schematic block diagram of an embodiment of the control system and method for an electric motor driven cyclic load of the present invention.

Before explaining the present invention in detail, it is to be understood that the invention is not limited to the details of construction and arrangement of parts illustrated in the accompanying drawings, since the invention is capable of other embodiments and of being practiced or carried out in various ways commensurate with the claims herein. Also, it is to be understood that the phraseology or terminology employed herein is for the purpose of description and not of limitation.

FIGS. 1–4 present embodiments of the control system and method, generally designated 20, of the present invention. The control system is used for controlling a cyclic load, generally designated 22, as well as controlling the AC (alternating current) motor, generally designated 24, driving the cyclic load. The AC motor has a rotor 26 driven by the magnetic field created in the field winding 28 by the alternating voltage of an AC power source 30.

Referring to the example of FIG. 1, the control system 20 may be described as being generally comprised of a flywheel 36 rotatably connectable between the motor 24 and the cyclic load 22; transducer means 38 for generating a transducer signal which is a function of the cycle speed of the cyclic load 22; tachometer means 40 for generating a tachometer signal which is a function of the speed of rotation of the motor's rotor 26; outside set point means 42 for generating an outside set point signal representative of a desired set point cycle speed of the cyclic load 22; controller means, generally designated 44, for receiving and processing the transducer signal, the tachometer signal, and the outside set point signal to generate a control signal representative of an adjustment to the frequency of the power supplied to the motor 24 needed to create the difference between the speed of rotation of the motor's magnetic field and the speed of rotation of the motor's rotor 26 required to achieve the set point cycle speed; and variable frequency power supply means 46, having a power input 48 connectable to the AC power source 30 and a power output 50 connectable to the AC motor 24, for receiving and processing the control signal to adjust the frequency of the power supplied to the AC motor 24 and thereby achieve the set point cycle speed of the cyclic load 22. In other words, the control system 20 provides a method of controlling an AC motor 24 and cyclic load 22 comprising: controlling the cycle speed of the cyclic load 22 by adjusting the frequency of the electric power supplied to the motor 24 in order to maintain a difference between the speed of rotation of the magnetic field and the speed of rotation of the rotor 26; storing rotational kinetic energy provided by the motor 24 and load 22 on a rotating mass having a relatively large moment of inertia, such as flywheel 36, during portions of a cycle of the cyclic load 22 when there is excess energy created by the motor 24 or cyclic load 22; and returning the stored rotational kinetic energy to drive the cyclic load 22 during portions of a cycle of the cyclic load 22 when there is an energy demand by the cyclic load 22.

Figure 2:
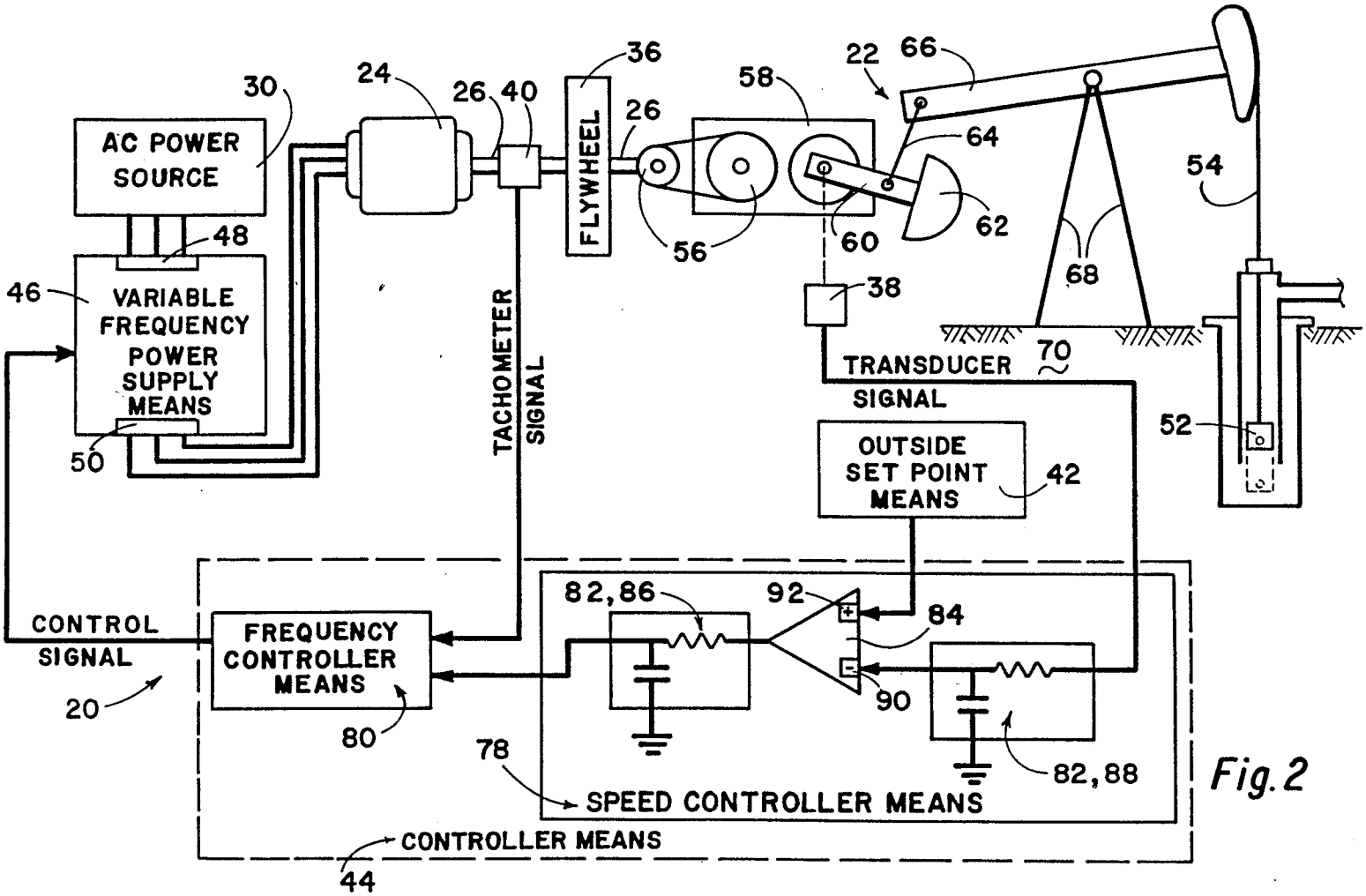
FIG. 2 is a schematic diagram of a beam pumping unit and another embodiment of the control system and method of FIG. 1.
Figure 3:
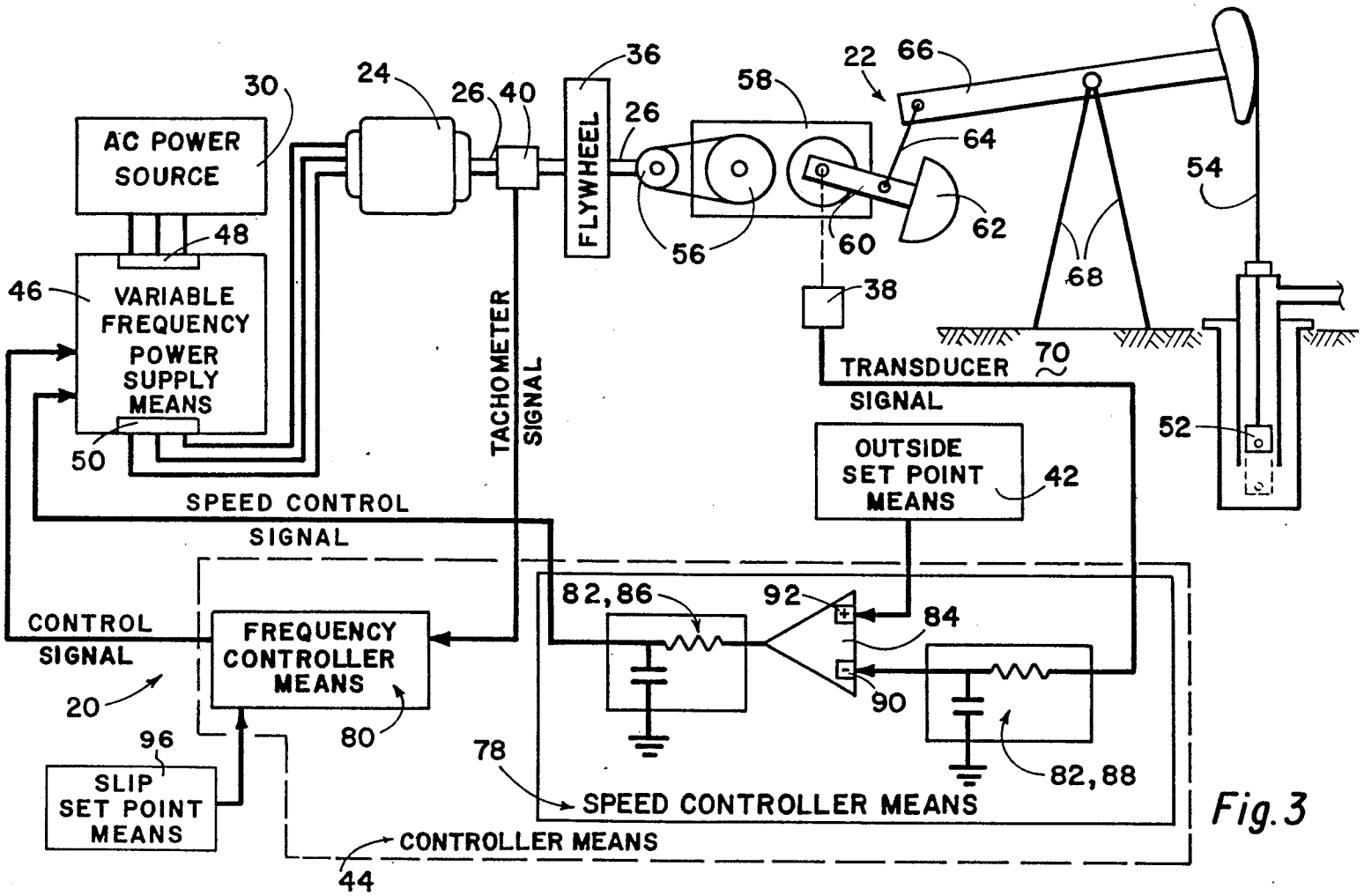
FIG. 3 is a schematic diagram of a beam pumping unit and another embodiment of the control system and method of FIG. 1.

As exemplified in FIGS. 2 and 3, the cyclic load 22 is a pumping unit, also generally designated 22, driven by the AC motor 24. Typically, the pumping unit 22 includes a downhole underground pump 52 and a rod string 54 connected between the pumping unit and the downhole pump 52 for actuating the downhole pump 52. It is intended to be understood that the control system 20 may be used with virtually any cyclic load 22 driven by an AC motor 24 and therefore may be used with virtually any pumping unit 22 which imposes a cyclic load on an AC motor 24. Preferably, the control system 20 and method of the present invention are used with an oil well beam pumping unit, also designated 22, and exemplified in FIGS. 2 and 3.

A typical beam pumping unit 22 includes the following components in power train order: AC motor 24, motor rotor and drive shaft 26, belts and sheaves 56 connected to and driven by drive shaft 26, gear box 58 which connects the belts and sheaves to rotatingly drive the crank 60 and counterweight 62, a pivoted linkage or pitman 64 which connects the crank to the walking beam 66, a Samson post 68 supporting the walking beam 66 from the ground or other support structure 70, and the rod string 54 which is connected between the downhole pump 52 and the walking beam 66 at the opposite end of the walking beam 66 from the crank 60 and counterweight 62. The walking beam 66 is drivingly seesawed up and down by the pivoted linkage of the pitman 64 to the rotating crank 60. One complete rotation of the crank 60 activates one full cycle of the pump 52, i.e., one complete crank rotation drives the cyclic load 22 through one full cycle. The crank 60 is turned or rotated via the gear box 58 and belts and sheaves 56 by the rotor or drive shaft 26 of the electric motor 24.

The reciprocating action of the downhole pump 52 imposes an intermittent load on the rod string 54. The fluid must be lifted on the upstroke, but not on the downstroke. The counterweights 62 on the crank 60 are typically sized and phased to halve the cyclic load of the pump 52 and double the frequency of the loading, i.e., the counterweights are sized and phased to balance the weight of the rod string 54 plus one-half the weight of the fluid in the pump including surface back pressure. The crank must lift one-half the weight of the fluid on the upstroke and one-half the weight of the fluid on the downstroke (by lifting the counterweights). Nevertheless, the load on the rod string 54 and the pumping unit 22 varies dynamically and dramatically throughout a given cycle and the torque load is effectively reduced to zero as the pump 52 goes over the top of the upstroke and the bottom of the downstroke. Therefore, it can be seen that the cyclic load of pump 52 has subcycle speed and loading oscillations created by the presence or absence of fluid in the pump 52, the rotation of the counterweights 62, the dynamics of the rod string 54, etc.

As mentioned above, during a single stroke of the downhole pump 52 (one complete up and down motion), the crank 60 turns one complete revolution. In a traditional beam pumping unit (not having the control system 20 with flywheel 36 of the present invention), there are considerable periods during any given revolution of the crank 60 when the beam pumping unit 22 actually forces the motor 24 to speed up (negative torque load), i.e., the beam pumping unit 22 drives the rotor 26 at a higher r.p.m. than does the magnetic field of the AC power source. Under these circumstances, the rotor speed is often forced above the synchronous speed (defined by the speed of rotation of the magnetic field in the field windings 28) and the motor 24 becomes a line excited generator and actually feeds power back to the AC power source 30 while at the same time acting as a brake on the mechanical parts of the system. That is, the rotor 26 resists the loading forced upon it by the beam pumping unit 22. As previously discussed, this phenomenon is known as regeneration and is responsible for energy losses, both in the motor 24 and the beam pumping unit 22 components.

In the preferred embodiment of the present invention, the controller means 44 measures, (via the transducer signal) and controls (via the control signal) the cycle speed or interval of the cyclic load or pumping unit 22. The controller means 44 does not attempt to directly control subcycle speed or loading oscillations or variations, but instead adjusts the frequency of the power supplied to the motor 24 in order to maintain the difference, or slip speed, between the speed of rotation of the magnetic field and the speed of rotation of the rotor 26 necessary to prevent the cyclic load 22 from driving the motor 24 into regeneration. In other words, as the subcycle loadings of the crank 60 attempt to speed up or slow down the speed of rotation of the rotor 26, the controller means 44 adjusts the speed of rotation of the magnetic field so that the magnetic field is always rotating faster than the rotor and preferably within the highest efficiency range of the motor 24. As the beam pumping unit 22 and crank 60 go through portions of a cycle in which the crank 60 is speeding up the rotor 26, the controller means 44 is also increasing the speed of rotation of the magnetic field to increase the energy or torque the motor 24 supplies to the beam pumping unit 22. This excess energy is stored on the flywheel 36 as rotational kinetic energy. As the beam pumping unit 22 and crank go through portions of a cycle in which they are demanding energy and slowing down the speed of rotation of the rotor 26, the controller means 44 also retards or slows down the speed of rotation of the magnetic field in order to keep the motor 24 operating at high efficency and allowing the rotational kinetic energy stored on the flywheel 36 to drive the crank 60 and beam pumping unit or cyclic load 22.

Since the controller means 44 does not directly control subcycle speed or loading oscillations or variations, the flywheel 36 should be sized to have a sufficiently large moment of inertia to control the subcycle speed and loading oscillations of the cyclic load or pumping unit 22, as further explained below. The flywheel 36 may be any rotating mass which will receive and store rotational kinetic energy from the motor 24 and the cyclic load 22 during portions of a cycle when there is excess energy, e.g., when the counterweights 62 are trying to speed up the rotation of the drive shaft 26, and which will return the stored rotational kinetic energy to drive the walking beam 66, rod string 54 and pump 52 during portions of the cycle when the pump 52 and counterweights are demanding energy from the motor 24. In other words, the use of the flywheel 36 with control system 20 provides a method of using the rotational inertia of a rotating mass, such as flywheel 36, to control subcycle oscillations of a cyclic load 22, such as a beam pumping unit.

Referring to the example of FIG. 1, the control system 20 may also include frequency signal means 76 for generating a frequency signal which is a function of the AC power frequency output by the variable frequency power supply means 46. The controller means 44 receives and compares the frequency signal to the tachometer signal for determining the difference between the speed of rotation of the motor 24 magnetic field and the speed of rotation of the motor's rotor 26. The frequency signal means 76 provides a feedback signal for verifying that the variable frequency power supply means 46 is regulating its output frequency as requested by the control signal. The frequency signal means 76 should normally be unnecessary as a variable frequency power supply means 46 may be selected which is sufficiently reliable that it will control its output frequency as a function of the control signal without need for a feedback loop; or a variable frequency supply means 46 may be selected which has an integral feedback loop for controlling its own frequency output as directed by an outside signal (the control signal of the present invention).

In the example embodiment of FIG. 2, the controller means 44 comprises speed controller means 78 and frequency controller means 80. The speed controller means 78 receives and compares the transducer signal and the outside set point signal and generates a speed set point signal representative of an adjustment in the cycle speed needed to achieve the set point cycle speed of the cyclic load 22. The frequency controller means 80 receives and compares the tachometer signal and the speed set point signal and generates the control signal representative of the adjustment in the frequency of the power supplied to the motor necessary to create or adjust the motor's slip speed (slip speed is the difference between the speed of rotation of the motor's magnetic field and the speed of rotation of the motor's rotor 26). By adjusting the motor's slip speed, the motor 24 output torque is adjusted as needed to achieve the set point cycle speed of the cyclic load 22. In other words, the controller means 44 exemplified in FIG. 2 provides a method of maintaining a relatively constant torque output by the motor during a cycle of the cyclic load 22 by adjusting the frequency of the electric power supplied to the motor 24 in order to adjust the torque output by the motor 24. The speed controller means 78 also comprises integrating means, generally designated 82, for delaying the response of the speed controller means 78 to changes in the cycle speed of the cyclic load 22. The integrating means 82 should be a device or circuit which will average or dampen the effect of fluctuations in the cycle speed (transducer signal) on the speed control signal so that subcycle and transient variations in the cycle speed have little affect on the speed control signal output from the speed controller means 78.

The controller means 44 and control system 20 may be effected with pneumatic, hydraulic, electric, or electronic circuitry. Preferably, the control system 20 and controller means 44 are effected using digital or analog electronic circuitry. FIG. 2 presents an embodiment of the controller means 44 effected using an analog voltage system. In the example embodiment of FIG. 2, the speed controller means 78 is an operational amplifier (op-amp) 84 and two low pass filters, generally designated 86, 88. The analog low pass filters 86, 88 are an embodiment of integrating means 82. Each filter 86, 88 consists of a resistor and capacitor, which is a well known circuit for passing only frequencies lower than a limit defined by the value of the resistor and capacitor. The resistor and capacitor may be of variable value in order to adjust the bandwidth of the filters 86, 88.

Continuing to refer to the example of FIG. 2, the transducer means 38, which may be a tachometer or equivalent device for transforming the rotation of the crank 60 into an analog voltage signal, outputs the analog transducer signal which is normally directly proportional to the cycle speed of the crank 60 or cyclic load 22. The transducer signal is applied to the negative, inverting input 90 of op-amp 84. The op-amp 84 compares the transducer signal to the analog outside set point signal, which is applied to the positive input 92 of op-amp 84, from outside set point means 42. The outside set point means may be a variable resistor and voltage source having an output range scaled to the desired cycle speed range of the cyclic load 22. The outside set point means 42 may also be an integral component of the speed controller means 78. The op-amp 84 compares the transducer signal to the outside set point signal and generates an analog speed set point signal which is proportional to the difference between the outside set point signal and the transducer signal. The speed set point signal is an inverse function of the cycle speed of the crank 60, since the motor speed or speed of rotation of the rotor 26 should be varied inversely to the cycle speed of the crank 60, i.e., if the crank 60 is cycling too slowly, the rotor speed or torque should be increased to increase the cycle speed of the crank 60 or cyclic load 22. This inversion in the signal between the cyclic load 22 and the motor 24 may be created by using a transducer means 38 with an inverted output, by connecting the transducer signal to the inverting input 90 of op-amp 84 as illustrated in FIG. 2, by placing an inverter in the output of the op-amp 84, etc.

The frequency controller means 80 is preferably an analog adding or summing device, also designated 80. The frequency controller means 80 receives the tachometer signal from the tachometer means 40. The tachometer means 40 may be a tachometer or equivalent device for transforming the rotation of the rotor 26 into an analog voltage signal. The analog tachometer signal is proportional to the speed of rotation of the rotor 26. The frequency controller means 80 adds the speed set point signal to the tachometer signal and generates an analog control signal. The variable frequency power supply means 46 receives the control signal and varies the frequency of the power supplied to the motor 24 as a function of the control signal. Since the frequency controller means 80 adds the speed set point signal to the tachometer signal (which is a function of the speed of rotation of rotor 26) to generate the control signal, the speed of rotation of the magnetic field is adjusted to a speed faster than the rotor speed, the difference or slip speed being a function of the speed control signal. All of the analog components should be selected to have input and output ranges compatible with one another and with the operating ranges of the components of the cyclic load or beam pumping unit 22.

It is well known that when an alternating voltage is applied to the field windings of an electric motor, the magnetic field that is induced inside the stator rotates at a speed defined by the frequency of the alternating voltage. It is also known that the motor rotor 26 is accelerated by the magnetic field and will turn almost synchronously with the speed of rotation of the magnetic field unless the rotor 24 is loaded or braked. If the rotor 26 is loaded or braked, a driving torque is generated which is proportional to the speed difference between the rotor 26 and the magnetic field. The speed difference is called the slip speed, since the rotor 26 is continually slipping behind the rotating magnetic field.

Since the magnetic field rotates at a speed defined by the frequency of the power supplied to the motor 24 and since the motor output torque is proportional to the speed difference between the rotor 26 and the magnetic field, the motor output torque may be varied by adjusting the frequency of the power supply to the motor and thereby adjusting the difference or slip speed between the speed of rotation of the magnetic field and the speed of rotation of the rotor 26. Therefore, the cycle speed of the crank 60 or cyclic load 22 can be controlled by adjusting the frequency of the alternating voltage or current applied to the field windings 28 of motor 24, as does the control system 20 exemplified in FIG. 2.

FIG. 3 presents another, more preferred, embodiment of the controller means 44. Referring to the example of FIG. 3, the controller means 44 comprises speed controller means 78, slip set point means 96, and frequency controller means 80. The speed controller means 78 receives and compares the transducer signal and the outside set point signal and generates a speed control signal representative of the adjustment in the output torque of the AC motor 24 needed to achieve the set point cycle speed of the cyclic load 22. The slip set point means 96 generates a slip set point signal representative of a desired set point difference between the speed of rotation of the motor's magnetic field and the speed of rotation of the motor's rotor 26, i.e., the slip speed. The frequency controller means 80 receives and compares the tachometer signal and the slip set point signal and generates the control signal representative of the adjustment and the power supply frequency output to the motor needed to achieve the desired set point difference between the speed of rotation of the magnetic field and the speed of rotation of the rotor 26. The slip set point means 96, may be a discrete component, may be an integral part of the frequency controller means 80, or may be provided from a remote station. The slip set point means should be a device capable of providing an adjustable, constant value signal which is functionally compatible with the frequency controller means 80 and tachometer signal.

The variable frequency power supply means 46 includes means for receiving the speed control signal and varying the voltage per unit of frequency (voltage/-hertz) output by the variable frequency power supply means 46 to the motor 24 in order to adjust the output torque of the AC motor 24 and thereby the cycle speed of the cyclic load 22. In other words, the controller means 44 provides a method of adjusting the frequency of the electric power supplied to the motor 24 to maintain a substantially constant preselected difference in the speed of the rotation of the magnetic field and the speed of rotation of the rotor during a cycle of the loading cycle and of adjusting the voltage per unit of frequency supplied to the motor 24 in order to adjust the torque output by the motor 24 and thereby control the cycle speed of the cyclic load 22.

As with the embodiment of FIG. 2, the controller means 44 and control system 20 of FIG. 3 may be implemented with pneumatic, hydraulic, or electric componentry. Preferably, the controller means 44 is effected using digital or analog electronic circuitry.

FIG. 3 presents an example embodiment of the controller means 44 implemented using analog voltage circuitry. Referring to FIG. 3, the general operation is similar to the operation of the embodiment of FIG. 2 described above. The important distinction is that the speed control signal from op-amp 84 is applied directly to the variable frequency power supply means 46 and the frequency controller means 80 receives its set point from slip set point means 96 rather than from speed controller means 78. The frequency controller means 80 of FIG. 3 is used to hold the slip speed constant, i.e., the frequency controller means 80 maintains a preselected fixed margin between the speed of rotation of the magnetic field and the speed of rotation of the rotor 26. The frequency controller means 80 does this by adding a constant slip set point signal from the slip set point means 96 to the tachometer signal. Therefore, regardless of the speed of rotation of the rotor 26, the frequency controller means 80 and control signal adjust the frequency of the power supply to the motor 24 from the variable frequency power supply means 46 and cause the speed of rotation of the magnetic field to track the speed of rotation of the rotor 26 although at a selected and fixed speed margin above the speed of rotation of the rotor 26. In other words, the frequency controller means 80 provides a method of adjusting the frequency of the electric power supplied to the motor 24 to create a positive difference between the speed of rotation of the motor's magnetic field and the speed of rotation of the motor's rotor 26 so that the magnetic field rotates at a preselected greater speed than the rotor regardless of the magnitude of the cyclic load 22 or the speed of rotation of the rotor 26. The slip set point means 96 should allow the slip set point to be selectively adjusted in order to select the margin or difference between the speed of rotation of the magnetic field and the speed of rotation of the rotor 26.

The speed controller means 78 of FIG. 3 operates generally as described with the embodiment of FIG. 2 above. As previously mentioned, the important distinction is that the speed control signal is applied directly to the variable frequency power supply means 46 in the embodiment of FIG. 3. The variable frequency power supply means 46 receives the speed control signal and adjusts the volts output per unit of frequency to the motor 24. The embodiment of FIG. 3 is able to maintain the slip speed within the motor manufacturer's recommended range while adjusting the volts per unit of frequency ratio within a range recommended by the motor manufacturer in order to obtain the desired torque output from the motor 24 at a maximum efficiency of the motor 24.

Referring to the example of FIGS. 2 and 3, the speed controller means 78 and frequency controller means 80 provide a double control loop which provides for stable operation of the control system 20. The speed controller means 78 provides a control loop which adjusts the speed of rotation of the magnetic field of the beam pumping unit 22 by varying the output torque of the motor 24. The frequency controller means 80 provides a fast acting control loop which adjusts the speed of rotation of the magnetic field of the motor 24 in response to subcycle variations or oscillations in the rotor speed. The frequency controller means 80 therefore provides for a relatively constant motor torque output (since the slip speed is held relatively constant) and provides for highly efficient operation of the motor 24.

Referring to example FIGS. 2 and 3, as previously mentioned, the controller means 44 and control system 20 may also be effected with digital circuitry and preferably digital electronic circuitry, although other forms of digital circuitry, such as pneumatic or hydraulic, will also work. In order to implement a digital circuit, referring to the example of FIGS. 2 and 3, speed controller means 78 and frequency controller means 80 are replaced with microprocessors, microprocessor controllers, or equivalent digital computer devices. The outside set point means 42 and slip set point means 96 are replaced with adjustable digital counters or equivalent devices which will output a constant, selected digital signal. Tachometer means 40 is replaced with a tachometer which produces a digital or pulsed signal, a tooth wheel (not illustrated) on the rOtor or drive shaft 26 with a stationary inductive pickup which produces a voltage pulse as each tooth goes by, or equivalent device. The digital transducer means 38 may be a device identical to the tachometer means 40 which is mounted on the shaft about which the crank 60 rotates; a magnetic switch which produces a voltage pulse each time the crank 60 makes a complete revolution, e.g., a switch positioned at top dead center of the crank's path of revolution; or equivalent device. As with the analog embodiments discussed above, the digital components of the control system 20 must be selected or scaled to have input and output ranges which are functionally compatible with one another and with the operating ranges of the components of the cyclic load or beam pumping unit 22.

The operation of the digital circuits is essentially the same as the analog circuits discussed above. The digital speed controller means 78 receives the digital transducer signal from the transducer means 38 and the digital outside set point signal from the outside set point means 42, compares the signals, and generates the digital speed set point signal which is proportional (or inversely proportional, as discussed above) to the difference between the outside set point signal and the transducer signal. The integrating means 82 (low pass filters 86, 88) may be written or programmed in the programming of the set point controller means 78, as further discussed below. In the embodiment of FIG. 2, the digital speed control signal is applied to the input of the frequency controller means 80 to be used in adjusting the slip speed and therefore the torque output by the AC motor 24, as discussed above. In the embodiment of FIG. 3, the digital speed control signal is applied to the variable frequency power supply means 46 for varying the volts per hertz ratio to vary the torque output by the motor 24. The variable frequency power supply means 46 must be capable of receiving and using a digital signal to adjust the volts per hertz ratio.

The digital frequency controller means 80 receives the digital tachometer signal and compares it to the digital speed set point signal (in the embodiment of FIG. 2) or to the digital slip set point signal (in the embodiment of FIG. 3) and generates a digital control signal to adjust the frequency of the power supplied to the motor 24, as do the analog circuits discussed above.

Figure 4:
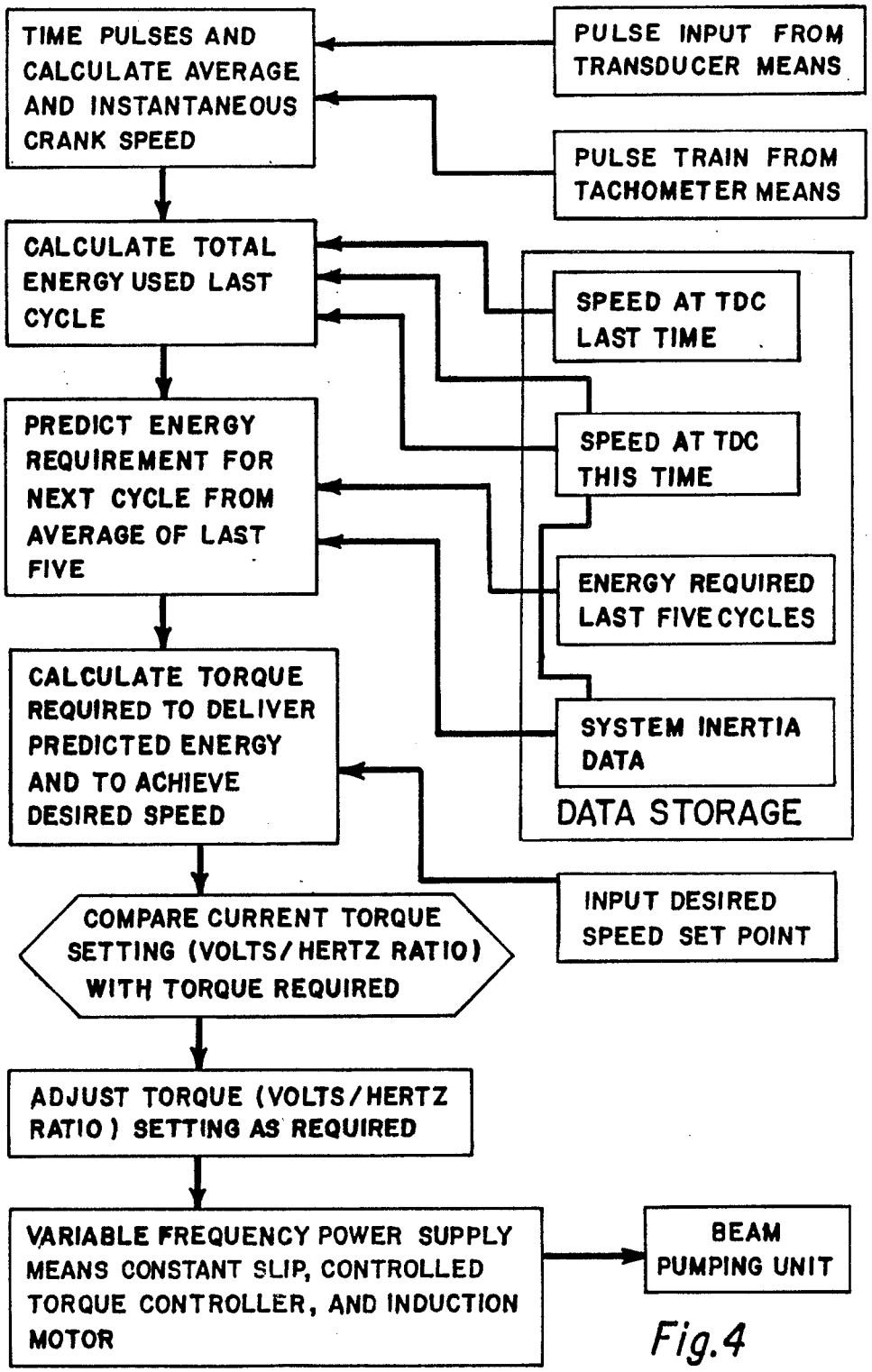
FIG. 4 is a flow diagram of an embodiment of a computer program for use with the speed controller means of FIG. 3.

The digital speed controller means 78 may be programmed to do more than generate a speed control signal proportional (or inversely proportional) to the difference in the transducer signal and the outside set point signal. As mentioned above, the digital speed controller means 78 may include the integrating means 82 and may also include the outside set point means 42. Further, in order to effect the integrating means 82, the digital speed controller means 78 may be programmed to analyze the recent history of the cyclic load 22 and to use the analysis to predict the load during the next cycle. In this way, a specific motor output torque can be calculated that will deliver more precisely the amount of energy required to maintain the correct cycle speed of the cyclic load 22. In other words, an average of the last several cycles energy usage can be made and an exact calculation can be carried out, taking into account the current speed and the target speed of the cyclic load 22 or crank 60, so that the motor torque can be set at such a value that the next cycle of the cyclic load will last exactly as long as needed, assuming that the predicted energy usage is accurate. FIG. 4 presents an example of a flow diagram which may be used to create such a program for the control system 20 of FIG. 3. With simple modifications, this flow diagram may also be used with the control system 20 embodied in FIG. 2. The digital speed controller means 78 and digital frequency controller means 80 may be combined in one microprocessor or digital computer. The slip set point means 96 and outside set point means 42 may also be incorporated into such a microprocessor or digital computer.

The speed controller means 78, particularly if a microprocessor or digital computer, may also include a starting algorithm. Since the control system 20 allows much smaller electric motors 24 to be employed, the problem of starting a beam pumping unit 22 becomes acute. In the past, concern over starting a pumping unit made operators resistant to reduction in motor size. Therefore, the preferred controller means 44 will have an algorithm to control a rocking start. This approach mimics that used by human operators when they are faced with a stuck beam pumping unit 22 in the field. The motor 24 is turned on to swing the counterweights 62 upward and the motor 24 is then switched off as the counterweights slow down on the upswing. The operator or program then waits for the backswing, i.e., the downswing of the counterweights 62, and re-engages the motor 24 as the counterweights begin to swing forward again so that the counterweights 62 swing higher the second time. This process is repeated until the counterweights 62 are able to go over the top dead center of the crank's 60 path of rotation and the pumping unit 22 is then able to carry on operating with power applied continuously. The variable frequency power supply means 46 should be selected so that it is able to power on the backswing as well as on the forward swing and thus the controller means 44 can be programmed to perform this starting algorithm even more effectively than unaided human operator.

Variable frequency power supply means 46 are commercially available. They are generally described as a solid-state electronic switching device that accepts three phase, fixed frequency (50/60 hertz), fixed electrical power (e.g., 480 volts) at the input and provides three phase, variable frequency, variable voltage at the output. Further requirements for the purposes of the present invention are as follows: a large frequency range (0.5 hertz through 150 hertz); controllable volts/hertz ratio; pulse-width modulated output circuit for high input power factor; transistorized output devices for high efficiency; high rate of change of frequency capability (e.g., 600 hertz per second); and a horsepower range from 5 to 100 horsepower. A standard range of variable frequency power supply means 46 is available from Emerson Electric Company which possesses suitable characteristics. Emerson Electric Company designate these variable frequency power supply means 46, also known as variable speed drives, the "Laser 1" and "Laser 2" models and they are available in Nema 3 enclosures suitable for all weather service.

As previously discussed, since the control system 20 of the present invention maintains effectively constant motor torque to the rotating and articulating elements (belts and sheaves 56, gear box 58, crank 60, counterweights 62, walking beam 66, rod string 54, and downhole pump 52) during each individual pumping cycle, i.e., each cycle of the cyclic load 22, the controller means 44 is making no attempt to control the subcycle crank 60 speed. Therefore, the flywheel 36 is used to control the subcycle speed and loading variations.

Therefore, sufficient rotating mass must be included in the control system 20 to prevent the instantaneous crank 60 speed from straying to widely from the average crank 60 speed. This is achieved by adding mass to the flywheel 36 until the energy stored in the flywheel 36 as the crank speed increases with decreasing load is sufficient to power the pumping unit 22 as the crank speed tends to decrease with increasing load.

The flywheel 36 mass needed will vary considerably between specific applications of pumping units 22, since many parameters affect the calculation, such as pumping speed, counterweight mass, dynamometer card shape, pump off conditions, etc. However, the actual mass of the flywheel 36 is not critical as long as the flywheel 36 is oversized, since oversizing the flywheel 36 yields large energy storage and accordingly low speed variation but makes the flywheel a little more expensive. However, undersizing the flywheel may render the control system 20 and pumping unit 22 inoperable.

Since the actual polished rod load, i.e., the dynamic load on the rod string 54, is modified if the rotational inertia of the pumping unit 22 components above ground is altered, the only precisely accurate method of sizing the flywheel 36 is to run a simulation with various sizes of flywheels until satisfactory performance is achieved. However, these calculations are exhaustive and there is no computer program available that handles them correctly. A perfectly satisfactory approach to sizing the flywheel 36 is to consider a worse case scenario, in which fifty percent of the energy required to drive the pumping unit 22 must be regenerated from within the control system 20 and pumping unit 22. Thus the flywheel 36, in combination with the rest of the pumping unit or cyclic load 22 inertia, must store enough energy to deliver one-half of the energy per cycle as it slows from the maximum allowed cycle speed to the minimum cycle speed.

For example, supposing a fully loaded twenty horsepower motor 24 is driving a beam pumping unit 22 at ten strokes per minute. Since each cycle lasts six seconds, the energy delivered per cycle is twenty horsepower times six horsepower-seconds, and thus the energy to be regenerated is half that value (sixty horsepower-seconds). Supposing further that the reasonable speed limits for the motor 24 are 1400 r.p.m. maximum and 800 r.p.m. minimum, the difference in rotational kinetic energy between that stored at 1400 r.p.m. and that stored at 800 r.p.m. must equal 60 horse power-seconds. This is assuming, for simplicity, that all the energy must be stored on the flywheel 36. In reality, a reasonable portion of the storage will take place on the sheaves 56 and counterweights 62 and the flywheel 36 can accordingly be reduced in size.

The formula for the kinetic energy stored in a rotating mass ($KE_r$) is given by the formula:

$$\text{rotational kinetic energy} = KE_r = J \times w^2/(2 \times 550 \times 32.2) \text{ hp-s}$$

where:

$J$ is moment of inertia lb-ft$^2$ $W$ is angular speed radians/second $KE_r$ is kinetic energy horsepower-seconds so, the energy yielded by a speed change can be calculated as follows:

$$\text{energy change} = J \times (w_2^2 - w_1^2)/(2 \times 550 \times 32.2) \text{ hp-s}$$

where:

$W_1$ is minimum speed radians/second $W_2$ is maximum speed radians/second if we set this equal to the required energy of 60 hp-s calculated above:

$$60 = J \times (W_2^2 - w_1^2)/(2 \times 550 \times 32.2) \text{ hp-s}$$

and, rearrange the terms:

$$J = 60 \times 2 \times 550 \times 32.2/(w_1^2 - w_2^2) \text{ lb-ft}^2$$

substituting the values for our example:

where:

$$W_1 = 800 \text{ rpm} = 83.8 \text{ radians/second}$$

$$W_2 = 1{,}400 \text{ rpm} = 146.6 \text{ radians/second}$$

$$\text{moment of inertia} = 60 \times 2 \times 550 \times 32.2/(146.6^2 - 83.8^2) = 149.9 \text{ lb-ft}^2$$

This value of moment of inertia can be supplied by a 3 ft diameter disc whose weight is:

$$\text{mass of disc} = 2 \times J/\text{radius}^2 = 130.6 \text{ lb}$$

The actual design of the flywheel 36 will concentrate the mass at the rim, and thus an even smaller mass will be required.

Preferably, the mass of the flywheel 36 is adjustable, i.e., the flywheel 36 is of a design which allows weights to be added and removed in order to match the flywheel 36 as closely as possible to the needs of a specific cyclic load or pumping unit 22. In order to minimize the size of the flywheel 36 when used with a beam pumping unit 22, the flywheel should be placed on the motor 24 side of the belts and sheaves 56 and gear box 58. Typically, there is a 100 to 1 drive ratio between the motor and the crank and therefore placing the flywheel 36 on the motor 24 side of the gear box 58 reduces the required mass of the flywheel 36 by a factor of approximately 10,000 (since stored energy is proportional to the speed of rotation to the second power).

Although the control system 20 may be effected with various types of electric motors, e.g., synchronous electric motors, wound rotor electric motors, etc., in the preferred embodiment a three phase induction motor is used. More preferably, a high efficiency Nema B induction motor is used, as one of the advantages of the present invention is in facilitating the use of a high efficiency motor with a beam pumping unit 22.

In the embodiments of the control system 20 discussed above, the outside set point means 42 may be replaced by a remote set point from a source outside of the control system 20, such as a level control signal from the well or downhole pump 52 or from the tank or reservoir (not illustrated) into which the beam pumping unit 22 is discharging its pumped oil. In this manner, the cycle speed can be adjusted automatically over a long time period to maintain a constant fluid level in the well or reservoir. Similarly, the outside set point may be provided from a remote control panel or station.

The following explanation provides a better understanding of the principles of operation of the control system 20, as well as the differences between the control system 20 embodiments of FIGS. 2 and 3. It is first important to clearly understand how torque is produced in electric motor 24. Typically, an induction motor 24 has at least two split coils or field windings 28 arranged around the rotor 26. Each split coil is composed of two diametrically opposed sections. The magnetic field is produced by running an electric current through the coils 28. More typically, the electric motor has three split coils 28 or a multiple of three split coils 28 equidistantly positioned around the rotor. By selectively controlling which coil 28 has current, the orientation of the magnetic field can be changed. Normally, the coils 28 are powered sequentially, each with a sinusoidally varying current, and the resulting magnetic field rotates smoothly in time, while remaining substantially constant in magnitude. A compass needle or bar magnet placed in the center of the coils would spin synchronously, i.e., at the same speed of rotation as the speed of rotation of the magnetic field, as does an unloaded rotor. For example, a motor with nine pairs of split coils 28, when connected to three-phase, 60 hertz electric power, will produce a magnetic field which rotates at 1200 rpm.

If the rotor 26 is braked or loaded, it will develop torque as it tries to retain its synchronous speed with the magnetic field. If the rotor is slowed to selected speeds below synchronous speed, the torque can be measured at each speed and plotted to produce a torque curve, as exemplified in FIG. 5 above the X axis. If the speed of rotation of the rotor 26 is increased above the speed of rotation of the magnetic field, i.e., above synchronous speed, an almost identical, mirror image torque curve is produced below the X axis, as exemplified in FIG. 5. The curve can be extended to the left of the Y axis by driving the rotor 26 in reverse.

Figure 5:
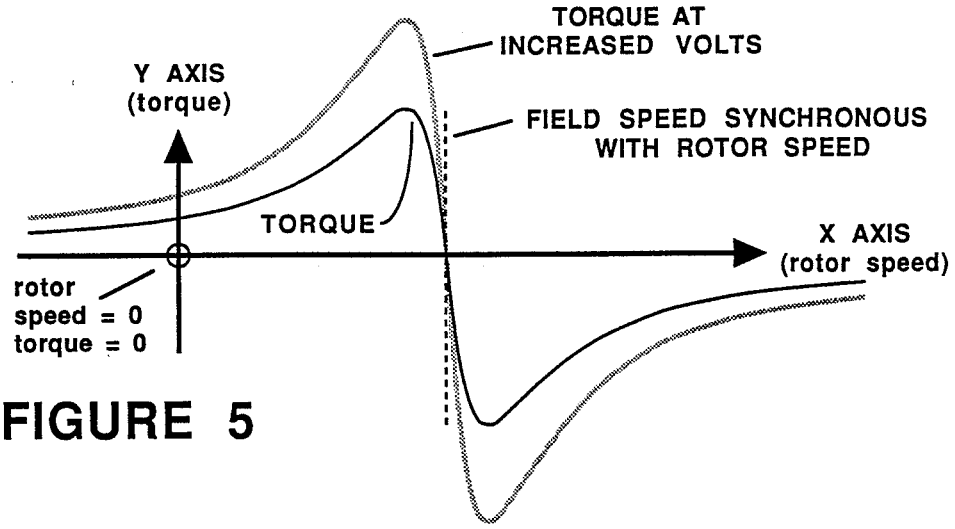
FIG. 5 illustrates torque curves for an electric motor at various power supply voltages and a constant power supply frequency.

As exemplified by the torque curves of FIG. 5, the amplitude of the torque curve can be increased, i.e., expanded along the Y axis, by increasing the voltage of the sinusoidal power applied to the coils or field windings 28 of the motor 24. Decreasing the coil voltage similarly contracts the curve.

Figure 6:
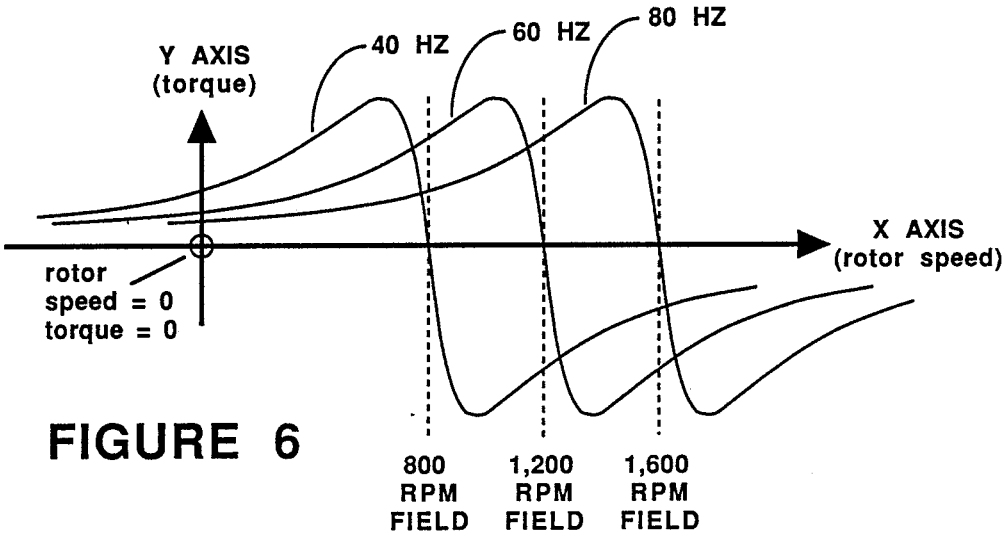
FIG. 6 illustrates torque curves for an electric motor at various power supply frequencies and at a constant power supply voltage per hertz ratio.

The torque curve can also be shifted along the X axis of a plot, as exemplified in FIG. 6, by adjusting the frequency of the voltage applied to the motor coils 28, although in order to keep the torque amplitude constant, the voltage per unit of frequency (volts/hertz ratio) must be kept constant as the frequency is adjusted. For example, if the motor has been using 480 volts at 60 hertz, the voltage must be dropped to 400 volts if the frequency is decreased to 50 hertz (480 volts$\times$50 hertz/60 hertz=400 volts).

Since the torque curve can be shifted along the X axis by changing the frequency and can be done so at a constant torque amplitude by adjusting the voltage proportionately with the frequency, i.e., keeping the volts/hertz ratio constant, a motor torque curve can be placed where desired along the X axis by changing the power supply frequency and appropriately adjusting the power supply voltage to maintain a constant volts/hertz ratio, as exemplified in FIG. 6. FIG. 6 illustrates the positioning of the torque curve along the X axis at three different power supply frequencies (40 hertz, 60 hertz, and 80 hertz) and at a constant volts/hertz ratio. Accordingly, FIG. 6 illustrates that the amplitude of the torque curve remains constant at all three power supply frequencies (since the volts/hertz ratio is the same at each of the three frequencies).

As previously discussed, the speed controller means 78 and frequency controller means 80 provide a double control loop which provides for stable operation of the control system 20. The speed controller means 78 provides a control loop which adjusts the long-term cycle speed of the beam pumping unit 22 by varying the output torque of the motor 24. The frequency controller means 80 provides a fast acting control loop which adjusts the speed of rotation of the magnetic field in response to subcycle variations or oscillations in the rotor 26 speed.

Figure 7:
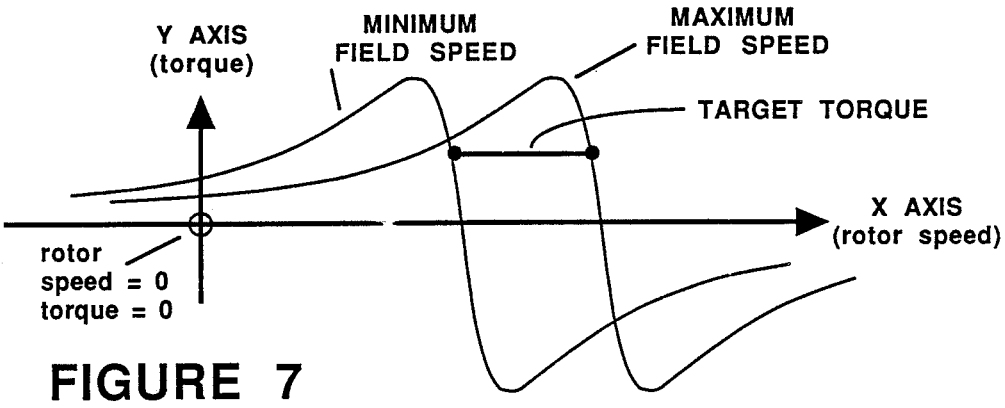
FIG. 7 illustrates the effect of the frequency controller means of FIGS. 2 and 3 on the torque curve of an electric motor.

The operation of the frequency controller means 80, or frequency control loop, is essentially the same for the embodiment of FIG. 2 and the embodiment of FIG. 3. The object of the frequency controller means 80 is to supply a relatively constant torque to the cyclic load 22 during any given cycle of the cyclic load in order to maintain peak motor efficiency. This can be achieved if both slip speed and power supply volts/hertz ratio are held constant. The task of the frequency controller means 80 can be viewed as delivering a target torque load (which is defined by the set point the frequency controller means 80 receives from the speed controller means 78 in FIG. 2 and from the slip set point means 96 in FIG. 3) at a range of rotor speeds. The frequency controller means 80 adjusts the motor torque curve until it matches the target torque by changing the frequency of the power supplied to the motor in order to change the rotational speed of the magnetic field. This is exemplified in FIG. 7, where it can be seen that the frequency controller means 80 varies the speed of rotation of the magnetic field as necessary to keep the rotor speed operating point (target torque) on the torque curve by shifting the torque curve along the X axis. In the embodiment of FIG. 2 and the embodiment of FIG. 3, the frequency controller means 80 is maintaining constant slip speed during any given cycle of the cyclic load by repeatedly adjusting the speed of rotation of the magnetic field so that the speed of rotation of the magnetic field stays a constant speed ahead of the speed of rotation of the rotor 26.

Figure 8:
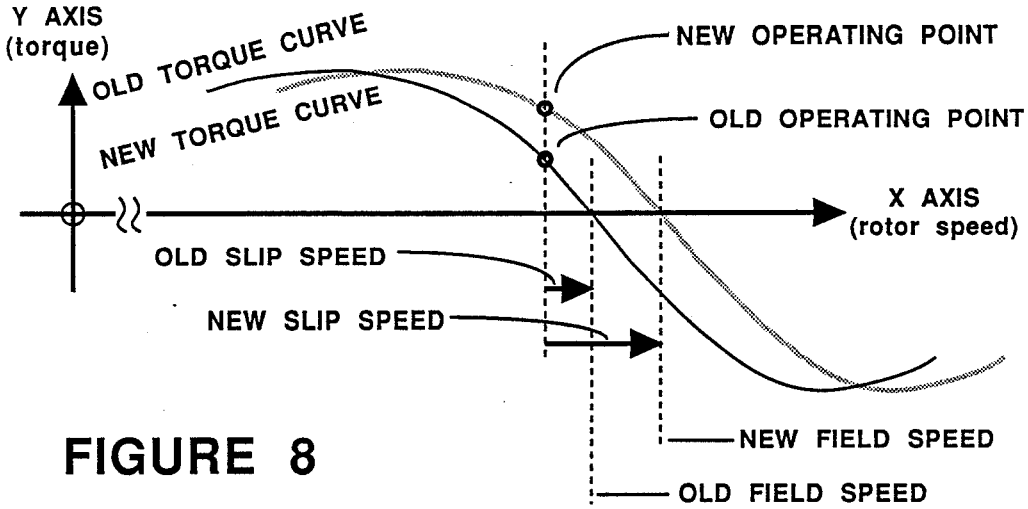
FIG. 8 illustrates the effect of the control system of FIG. 2 on the torque curve of an electric motor.

In order to understand the difference in the operation of the embodiments of FIGS. 2 and 3, it is necessary to consider a situation in which a new torque requirement is imposed by the speed controller means 78, i.e., it is necessary for the speed controller means 78 to adjust the long-term cycle speed of the cyclic load or beam pumping unit 22. From the previous discussion concerning torque adjustments in electric motors, it is understood that there are two ways to adjust the torque output of the electric motor 24. The first way, exemplified by the control system 20 of FIG. 2, is to increase the slip speed of the motor. The second way, exemplified by FIG. 3, is to increase the volts/hertz ratio in the motor while holding the slip speed constant. FIG. 8 illustrates motor torque curve changes made by the control system 20 of FIG. 2 in order to adjust motor output torque by adjusting slip speed to shift the torque curve. The slip speed is increased (or decreased, as appropriate) while the volts/hertz ratio is held constant. In other words, the magnetic field intensity is held constant and the torque curve is shifted to adjust the slip speed until the new torque requirement (operating point) is on the torque curve. The new torque requirement (new operating point in FIG. 8) is at a higher proportion of the peak torque motor capacity and at a higher position on the torque curve, so the slip speed is increased.

Figure 9:
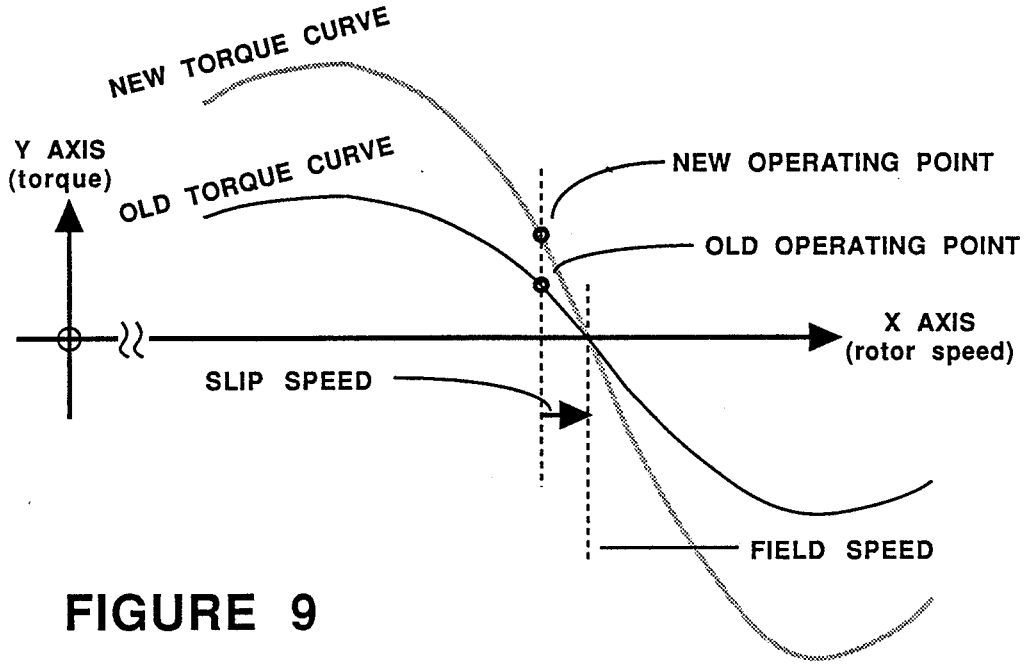
FIG. 9 illustrates the effect of the control system of FIG. 3 on the torque curve of an electric motor.

FIG. 9 illustrates the motor torque curve changes made by the control system 20 of FIG. 3 in order to hold the slip speed constant while the volts/hertz ratio is increased (or decreased, as appropriate) in order to amplify the torque curve. In other words, the control system 20 of FIG. 3 adjusts the volts/hertz ratio to amplify the torque curve until the new operating point is on the torque curve, i.e., the motor torque output at the operating point rotor speed is on the torque curve, without shifting the torque curve along the X axis. The magnetic field intensity (which is proportional to the volts/hertz ratio) is varied so that the new operating point (torque requirement) on the amplified torque curve remains at the same proportion of peak torque motor capacity and therefore the slip speed remains the same. By staying at the same proportion of the torque curve, the control system 20 of FIG. 3 keeps the motor operating at peak efficiency. In contrast, the control system 20 of FIG. 2 can (if the torque required deviates from motor design capacity) stray from peak efficiency.

While the invention has been described with a certain degree of particularity, it is manifest that many changes may be made in the details of construction and the arrangement of components without departing from the spirit and scope of this disclosure. It is intended to be understood that the invention is not limited to the embodiments set forth herein for the purposes of exemplification, but is to be limited only by the scope of the attached claim or claims including the full range of equivalency to which each element thereof is entitled.

What is claimed is:

1. A control system for an AC motor driven cyclic load, the AC motor having a rotor driven by a magnetic field, the system comprising:

a flywheel, rotatably connectable between the motor and the cyclic load, for receiving and storing rotational kinetic energy from the motor and the load, and for delivering rotational kinetic energy to the load;

transducer means for generating a transducer signal which is a function of the cycle speed of the cyclic load;

tachometer means for generating a tachometer signal which is a function of the speed of rotation of the motor's rotor;

outside set point means for generating an outside set point signal representative of a desired set point cycle speed of the cyclic load;

controller means for receiving and processing the transducer signal, the tachometer signal, and the outside set point signal to generate a control signal representative of the adjustment to the power supply frequency needed to achieve the set point cycle speed; and variable frequency power supply means, having a power input connectable to an AC power source and a power output connectable to the motor, for receiving and processing the control signal to adjust the frequency of the power supplied to the AC motor and thereby achieve the set point cycle speed of the cyclic load.

2. The system of claim 1:

wherein the flywheel is further defined as receiving and storing rotational kinetic energy from the motor and the cyclic load during portions of a cycle of the cyclic load when there is excess energy and returning the stored rotational kinetic energy to drive the cyclic load during portions of a cycle when there is an energy demand by the cyclic load.

3. The system of claim 1:

wherein the cyclic load has subcycle speed and loading oscillations.

4. The system of claim 3:

wherein the flywheel is further defined as having a sufficiently large moment of inertia to control the subcycle oscillations.

5. The system of claim 4 in which the cyclic load comprises:

a pumping unit, driven by the AC motor, which includes:

a down-hole underground pump; and a rod string, connected between the pumping unit and the down-hole pump, for actuating the down-hole pump.

6. The system of claim 1, comprising:

frequency signal means for generating a frequency signal which is a function of the AC power frequency output by the variable frequency power supply means; and wherein the controller means receives and compares the frequency signal to the tachometer signal for determining the difference between the speed of rotation of the motor's magnetic field and the speed of rotation of the motor's rotor.

7. The system of claim 1 in which the controller means comprises:

speed controller means for receiving and comparing the transducer signal and the outside set point signal and generating a speed set point signal representative of an adjustment in the cycle speed needed to achieve the set point cycle speed of the cyclic load; and frequency controller means for receiving and comparing the tachometer signal and the speed set point signal and generating the control signal representative of the adjustment in the power supply frequency necessary to create the difference between the speed of rotation of the motor's magnetic field and the speed of rotation of the motor's rotor, and thereby the motor output torque, needed to achieve the set point cycle speed of the cyclic load.

8. The system of claim 7 in which the speed controller means comprises:

integrating means for delaying the response of the speed controller means to changes in the cycle speed of the cyclic load.

9. The system of claim 1 in which the controller means comprises:

speed controller means for receiving and comparing the transducer signal and the outside set point signal and generating a speed control signal representative of the adjustment in the output torque of the AC motor needed to achieve the set point cycle speed of the cyclic load;

slip set point means for generating a slip set point signal representative of a desired set point difference between the speed of rotation of the motor's magnetic field and the speed of rotation of the motor's rotor;

frequency controller means for receiving and comparing the tachometer signal and the slip set point signal and generating the control signal representative of the adjustment in the power supply frequency output to the motor needed to achieve the desired set point difference between the speed of rotation of the magnetic field and the speed of rotation of the rotor; and in which the variable frequency power supply means further comprises:

means for receiving the speed control signal and varying the voltage output per unit of frequency to the AC motor in order to adjust the output torque of the AC motor and thereby the cycle speed of the cyclic load.

10. The system of claim 9 in which the speed controller means comprises:

integrating means for delaying the response of the speed controller means to changes in the cycle speed of the cyclic load.

11. The system of claim 1:

wherein the controller means is further defined as generating a control signal indicative of the power supply frequency output to the motor needed to create a positive difference between the speed of rotation of the motor's magnetic field and the speed of rotation of the motor's rotor so that the magnetic field rotates at a greater speed than the rotor regardless of the magnitude of the cyclic load.

12. A method of controlling an AC motor driven cyclic load in which the AC motor has a rotor driven by a rotating magnetic field, comprising:

controlling the cycle speed of the cyclic load by adjusting the frequency of the electric power supplied to the motor in order to maintain a difference between the speed of rotation of the magnetic field and the speed of rotation of the rotor, the controlling step further comprising:

generating a transducer signal which is a function of the cycle speed of the cyclic load;

generating a tachometer signal which is a function of the speed of rotation of the motor's rotor;

generating an outside set point signal representative of a desired set point cycle speed of the cyclic load;

generating a control signal adapted to maintain the cycle speed of the load at the set point cycle speed by comparing the difference in the transducer signal and tachometer signal to the outside set point signal; and using the control signal to adjust the frequency of the electric power supplied to the motor;

storing rotational kinetic energy provided by the motor and load on a rotating mass having a relatively large moment of inertia during portions of a cycle of the cyclic load when there is excess energy; and returning the stored rotational kinetic energy to drive the cyclic load during portions of a cycle of the cyclic load when there is an energy demand by the cyclic load.

13. The method of claim 12 in which the controlling step further comprises:

maintaining a relatively constant torque output during a cycle of the cyclic load by adjusting the frequency of the electric power supplied to the motor to maintain the torque output by the motor.

14. The method of claim 3 in which the storing and returning steps further comprise:

using the rotational inertia of the rotating mass to control subcycle oscillations of the cyclic load.

15. The method of claim 12 in which the controlling step further comprises:

adjusting the frequency of the electric power supplied to the motor to maintain a substantially constant preselected difference in the speed of the rotation of the magnetic field and the speed of rotation of the rotor during a cycle of the loading cycle; and adjusting the voltage output per unit of frequency supplied to the motor in order to adjust the torque output by the motor and thereby control the cycle speed of the cyclic load.

16. The method of claim 12:

wherein the controlling step is further defined as adjusting the frequency of the electric power supplied to the motor to create a positive difference between the speed of rotation of the motor's magnetic field and the speed of rotation of the motor's rotor so that the magnetic field rotates at a greater speed than the rotor regardless of the magnitude of the cyclic load.

17. A control system for an AC motor driven cyclic load, the AC motor having a rotor driven by a magnetic field, the cyclic load having subcycle speed and loading oscillations, the system comprising:

a flywheel, rotatably connectable between the motor and the load, for receiving and storing rotational kinetic energy from the motor and the load during portions of a cycle of the cyclic load when there is excess energy and for delivering rotational kinetic energy to drive the load during portions of a cycle when there is energy demand by the cyclic load, the flywheel having a sufficiently large moment of inertia to control subcycle speed variations of the cyclic load;

transducer means for generating a transducer signal which is a function of the cycle speed of the cyclic load;

tachometer means for generating a tachometer signal which is a function of the speed of rotation of the motor's rotor;

outside set point means for generating an outside set point signal representative of a desired set point cycle speed of the cyclic load;

speed controller means for receiving and comparing the transducer signal and the outside set point signal and generating a speed set point signal representative of an adjustment in the cycle speed needed to achieve the set point cycle speed of the cyclic load;

frequency controller means for receiving and comparing the tachometer signal and the speed set point signal and generating the control signal representative of the power supply frequency necessary to create the difference between the speed of rotation of the motor's magnetic field and the speed of rotation of the motor's rotor, and thereby the motor output torque, needed to achieve the set point cycle speed of the cyclic load; and variable frequency power supply means, having a power input connectable to an AC power source and a power output connectable to the AC motor, for receiving and processing the control signal to adjust the frequency of the power supplied to the AC motor and thereby achieve the set point cycle speed of the cyclic load.

18. The system of claim 17 in which the cyclic load comprises:

a pumping unit, driven by the AC motor, which includes:

a down-hole underground pump;

a rod string, connected between the pumping unit and the down-hole pump, for actuating the down-hole pump.

19. A control system for an AC motor driven cyclic load, the AC motor having a rotor driven by a magnetic field, the cyclic load having subcycle speed and loading oscillations, the system comprising:

a flywheel, rotatably connectable between the motor and the load, for receiving and storing rotational kinetic energy from the motor and the load during portions of a cycle of the cyclic load when there is excess energy and for delivering rotational kinetic energy to drive the load during portions of a cycle when there is energy demand by the cyclic load, the flywheel having a sufficiently large moment of inertia to control subcycle speed variations of the cyclic load;

transducer means for generating a transducer signal which is a function of the cycle speed of the cyclic load;

tachometer means for generating a tachometer signal which is a function of the speed of rotation of the motor's rotor;

outside set point means for generating an outside set point signal representative of a desired set point cycle speed of the cyclic load;

speed controller means for receiving and comparing the transducer signal and the outside set point signal and generating a speed control signal representative of the adjustment in the output torque of the AC motor needed to achieve the set point cycle speed of the cyclic load;

slip set point means for generating a slip set point signal representative of a desired set point difference between the speed of rotation of the motor's magnetic field and the speed of rotation of the motor's rotor;

frequency controller means for receiving and comparing the tachometer signal and the slip set point signal and generating the control signal representative of the adjustment in the power supply frequency output to the motor needed to achieve the desired set point difference between the speed of rotation of the magnetic field and the speed of rotation of the rotor; and variable frequency power supply means, having a power input connectable to an AC power source and a power output connectable to the AC motor, for receiving and processing the control signal to adjust the frequency of the power supplied to the AC motor and for receiving the speed control signal and varying the voltage output per unit of frequency to the AC motor in order to adjust the output torque of the motor and thereby the cycle speed of the cyclic load.

20. The system of claim 19 in which the speed controller means comprises:

integrating means for delaying the response of the speed controller means to changes in the cycle speed of the cyclic load.

21. The system of claim 19 in which the cyclic load comprises:

a pumping unit, driven by the AC motor, which includes:

a down-hole underground pump;

a rod string, connected between the pumping unit and the down-hole pump, for actuating the down-hole pump.

* * * * *

UNITED STATES PATENT AND TRADEMARK OFFICE

CERTIFICATE OF CORRECTION

PATENT NO. : 4,971,522

DATED : November 20, 1990

INVENTOR(S) : Duncan M. Butlin

It is certified that error appears in the above-identified patent and that said Letters Patent is hereby corrected as shown below:

IN THE CLAIMS:

Column 19, claim 1, line 63, insert --AC-- before the word "motor,";

Column 21, claim 14, line 63, change "3" to --13--; and

Column 24, claim 19, line 20, insert --AC-- before the word "motor".

Signed and Sealed this

Sixteenth Day of August, 1994

*Attest:*

*Attesting Officer*

BRUCE LEHMAN

*Commissioner of Patents and Trademarks*